US008733311B2

(12) United States Patent
Manther

(10) Patent No.: US 8,733,311 B2
(45) Date of Patent: May 27, 2014

(54) SWITCHABLE ROLLER FINGER FOLLOWER

(75) Inventor: Debora Manther, Royal Oak, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 408 days.

(21) Appl. No.: 13/025,242

(22) Filed: Feb. 11, 2011

(65) Prior Publication Data

US 2011/0197843 A1 Aug. 18, 2011

Related U.S. Application Data

(60) Provisional application No. 61/304,042, filed on Feb. 12, 2010.

(51) Int. Cl.

| | |
|---|---|
| ***F01L 1/24*** | (2006.01) |
| ***F01L 1/18*** | (2006.01) |
| ***F01L 13/00*** | (2006.01) |
| *F01L 1/26* | (2006.01) |
| *F01L 1/34* | (2006.01) |

(52) U.S. Cl.

CPC ..... *F01L 1/185* (2013.01); *F01L 13/0063* (2013.01); *F01L 1/267* (2013.01); *F01L 1/34* (2013.01); *F01L 2105/00* (2013.01)

USPC ..... 123/90.44; 123/90.16; 123/90.27

(58) Field of Classification Search

CPC ..... F01L 1/185; F01L 13/0063; F01L 1/267; F01L 1/34; F01L 2105/00

USPC ..... 123/90.16, 90.27, 90.44

See application file for complete search history.

(56) References Cited

U.S. PATENT DOCUMENTS

| | | | | |
|---|---|---|---|---|
| 6,988,473 | B2 * | 1/2006 | Rohe et al. | 123/90.16 |
| 7,174,869 | B2 | 2/2007 | Proschko et al. | |
| 7,308,872 | B2 * | 12/2007 | Sellnau et al. | 123/90.16 |
| 7,849,828 | B2 * | 12/2010 | Elnick et al. | 123/90.39 |
| 7,909,007 | B2 | 3/2011 | Manther et al. | |
| 7,926,455 | B2 | 4/2011 | Manther et al. | |
| 8,033,260 | B2 * | 10/2011 | Reinecke-Murmann et al. | 123/90.39 |
| 8,251,032 | B2 | 8/2012 | Manther | |
| 2002/0100441 | A1 * | 8/2002 | Maeda | 123/90.16 |
| 2003/0172886 | A1 * | 9/2003 | Pierik | 123/90.16 |
| 2003/0209217 | A1 * | 11/2003 | Hendriksma et al. | 123/90.44 |
| 2003/0217715 | A1 * | 11/2003 | Pierik | 123/90.16 |
| 2008/0149059 | A1 * | 6/2008 | Murphy et al. | 123/90.39 |
| 2008/0245326 | A1 * | 10/2008 | Gemein | 123/90.16 |
| 2009/0064954 | A1 * | 3/2009 | Manther | 123/90.44 |
| 2009/0217895 | A1 * | 9/2009 | Spath et al. | 123/90.16 |
| 2010/0139589 | A1 * | 6/2010 | Kim et al. | 123/90.16 |

* cited by examiner

*Primary Examiner* — Thomas Denion
*Assistant Examiner* — Jorge Leon, Jr.
(74) *Attorney, Agent, or Firm* — Lucas & Mercanti, LLP

(57) ABSTRACT

The finger follower employs two independent lost motion arms and a coupling device that locks both arms. Stops are provided both for the roller axle and for the arm swing. The axle stop and the end stops for the arm swing are positioned on the arm and the outer sidewall of the inner lever.

7 Claims, 9 Drawing Sheets

SWITCHABLE ROLLER FINGER FOLLOWER

This application claims the priority of U.S. 61/304,042 filed Feb. 12, 2010, which application is incorporated by reference herein.

FIELD OF INVENTION

This Invention relates to internal combustion engines and more particularly to switchable roller finger followers used in overhead cam engines where the finger followers can be deactivated in order to deactivate an intake and/or exhaust valve. The invention can also be used for cam profile switching.

BACKGROUND OF INVENTION

Switchable roller finger followers are known, see, for example, U.S. Pat. No. 7,174,869. Such finger followers have an outer lever pivotably mounted outside an inner lever and a roller rotatably mounted on a transverse axle in a slot in the inner liner. The top surface of the outer lever acts as a contact surface for a high lift cam and the top surface of the roller acts as a contact surface for a low lift cam. A coupling element is mounted at one end of the finger and oil from an oil source is used to activate the coupling element. When the coupling element is activated, it locks the outer lever to the inner lever and requires the follower to follow both the high lift cam and the low lift cam. When the coupling element is deactivated, the outer lever is free to pivot and, under the aid of a spring, the outer lever pivots freely in conjunction with the high lift cam. This movement by the outer lever is conventionally referred to as the lost motion stroke.

Conventionally, the outer lever is a unitary structure such that the coupling element need only operate as one part of the outer lever. Typically, the coupling device operated on a yoke portion of the outer layer, the yoke portion being transverse to the longitudinal axis of the finger follower. Conventionally, the roller axle is staked to the inner lever to maintain its lateral position relative to the inner lever.

SUMMARY OF INVENTION

The Invention is directed to a finger follower where the outer lever is designed as two separate outer arms, which are not joined by a transverse yoke and which can freely move independent of one another and a coupling element that operates on both arms simultaneously to simultaneously lock both arms.

Also, the Invention provides a coupling element that can be activated at any point during the pivotal movement of the arms, at any point during the lost motion stroke, but that locks the arms only when the arms are in a base position.

The Invention also provides stops for preventing the lateral movement of the roller axle and for transport and overswing of the arms.

The stops for preventing the lateral movement of the roller axle are axle stops which are on an inner sidewall of each of the arms. These axle stops avoid having to stake the roller axle to the lever, thereby simplifying manufacture of the finger follower.

The stops for transport and overswing of the arms are end stops and comprise two outer end stops and one inner end stop. The outer end stops can be located on the inner sidewall of each of the arms and the inner end stop located on each outer sidewall of the lever, in between the outer end stop; or the outer end stops can be located on each outer sidewall of the lever and the inner end stop located on the inner sidewall of each of the arms, in between the outer end stops. The end stops delimit the swing of the arms in relation to the inner lever both during transport and during operation in the workings of the engine.

Preferably, the outer end stops are on the inner sidewall of each of the arms and the inner end stop is on each outer sidewall of the inner lever.

The stops provided by the Invention simplify the overall manufacture of the follower. The mass of the end stops can be positioned to reduce the mass moment of inertia (MMOI).

The Invention can be defined as, in a switchable finger follower of the type having two separate outer arms pivotally mounted at one end of an inner lever, a roller rotatably mounted on a transverse axle in a slot in the inner lever, the outer arms extending longitudinally towards the other end of the inner lever and a coupling element mounted in the other end of the inner lever, for engagement with a locking surface of each of the arms to lock and unlock both arms simultaneously in a base position, wherein: one or more stops are provided, the one or more stops being:

(a) each of the arms has an axle stop on an inner wall; or (b) each of the arms has two outer end stops on an inner sidewall and the lever has an inner end stop on each outer sidewall positioned between the outer end stops: or (c) each of the arms has an inner end stop on an inner sidewall and the lever has two outer end stops on each outer side wall, the inner end stop positioned between the outer end stops.

Preferably, the lever has both the axle stops and the three end stops.

More preferably, the three end stops are the embodiment wherein the outer end stops are on the inner sidewall of each of the arms and the inner end stop is on each outer sidewall of the lever.

Preferably, the coupling element has a rod extending transversely from each sidewall of the inner lever and the rod is longitudinally movable into and out of engagement with a locking surface of the arms, to lock and unlock the arms in a base position; and a chamfered contact surface on a top wall at the other end of each of the arms to force the rod longitudinally towards the other end of the lever when the chamfered contact surfaces contacts the rod.

When the chamfered contact surface on the top wall of the arm contacts the rod during an upward stroke of the arm, the rod is moved longitudinally towards the other end of the lever so that the arm can move past the rod. Once the arm moves past the rod, the rod moves longitudinally towards the one end of the lever and the rod makes contact with the locking surface of the arm to lock the arm in the base position.

As can be appreciated, the upward force on the arm exceeds both the frictional forces between the rod and the oblong hole in which the rod moves and the longitudinal force on the rod so that the rod is moved by the upward motion of the arm and the interaction between the chamfered surface on the top wall of the arm and the rod.

Broadly, the Invention can be defined as follows:

A switchable finger follower for a valve train of an internal combustion engine, comprising:

a longitudinally extending, inner lever having a bottom wall with a valve stem support at one end of the lever and a lash adjuster contact surface at the other end of the lever and a slot extending through the lever from the bottom wall to a top wall of the lever;

a roller mounted on a transverse axle in the slot;

two separate, longitudinally extending outer arms, one end of each of the arms pivotally mounted at the one end of the lever, one of each of the arms mounted along one longitudinal sidewall of the lever and the other end of each of the arms extending towards the other end of the lever, each of the arms moving between the down position and a base position;

a restoring spring means for restoring the arms to the base position;

a coupling element mounted in a transverse end wall at the other end of the lever for engagement with a locking surface of each of the arms to lock and unlock the arms simultaneously; and one or more stops, wherein the stops are (a) an axle stop on an inner sidewall of each of the arms, or (b) two outer end stops on an inner sidewall of each of the arms and an inner end stop on each an outer sidewall of the inner lever, the inner end stop positioned between the outer end stops, or (c) one inner end stop on an inner sidewall of each of the arms and two outer end stops on each outer sidewall of the inner lever, the inner end stop positioned between the outer end stops.

Preferably, the two outer end stops are on the inner sidewall of each of the arms and the inner end stop is on each outer sidewall of the lever.

More preferably, the axle stop and the two outer end stops are on the inner sidewall of each of the arms and the inner end stop is on each outer sidewall of the inner lever.

The axle stop is preferably an elongate finger formed as part of the inner sidewall of each of the outer arms and directly opposes an end wall of the transverse axle.

The end stops are preferably longitudinal extending fingers which directly oppose one another. One of the end stops acts as an overswing stop so as to prevent overswing of the arm about its pivot point, while another is a transport stop for transport prior to assembly and disassembly.

Preferably, the coupling element having a rod extending transversely from each longitudinal sidewall of the inner lever, the rod longitudinally movable into and out of engagement with a locking surface on a bottom wall, at the other end of the arms to lock and unlock the arms in the base position; and a chamfered contact surface on a top wall at the other end of each of the arms to force the rod longitudinally towards the other end of the lever when the arm moves from the down position to the base position.

Longitude and latitude are with respect to a side view of the follower and transverse is with respect to a top view of the follower.

Preferably, the coupling element comprises:

a longitudinal extending blind bore extending from a transverse end wall at the other end of the lever into the lever;

a transverse, oblong hole extending from one longitudinal sidewall to the other longitudinal sidewall of the lever, the oblong hole transversely bisecting the blind bore;

the rod mounted in the oblong hole to transverse the blind bore;

a spring mounted in the blind bore at the blind end;

a longitudinally movable piston mounted in the blind bore on top of the spring, the piston, engaged with the rod and longitudinally movable therewith; and an end cap closing the blind bore and forming an oil chamber between the end cap and the piston for receiving fluid pressure from a lash adjuster, such that the fluid pressure forces the piston into the blind bore which longitudinally moves the rod into engagement with the other end of the arms.

Preferably, the chamfered surface on the top wall at the other end of each of the arms is directly above the locking surface on the bottom wall at the other end of each of the arms. More preferably, the chamfered surface and the locking surface are separated from each other by a transverse end wall at the other end of each of the arms.

Preferably, two C-shaped washers are press fitted on the rod, one of each adjacent the longitudinal sidewalls of the lever to maintain the position of the rod.

Preferably, the restoring spring means is two restoring springs which are each a torsion spring, each spring is mounted on a post extending transversely outward from the longitudinal sidewall, and each spring has a long leg which abuts the arm and a short leg that abuts a stop, the stop is affixed to the lever.

The upward force exerted by the restoring spring means, and more specifically the longitudinal vector of the force provided by the chamfered surface to the rod is greater than the longitudinal vector of force provided by the fluid pressure against the piston such that the arm moves the rod longitudinally in the oblong hole towards the other end of the lever.

These and other aspects of the Invention may be more readily understood by reference to one or more of the following drawings.

DETAILED DESCRIPTION OF THE INVENTION

Figure 1:
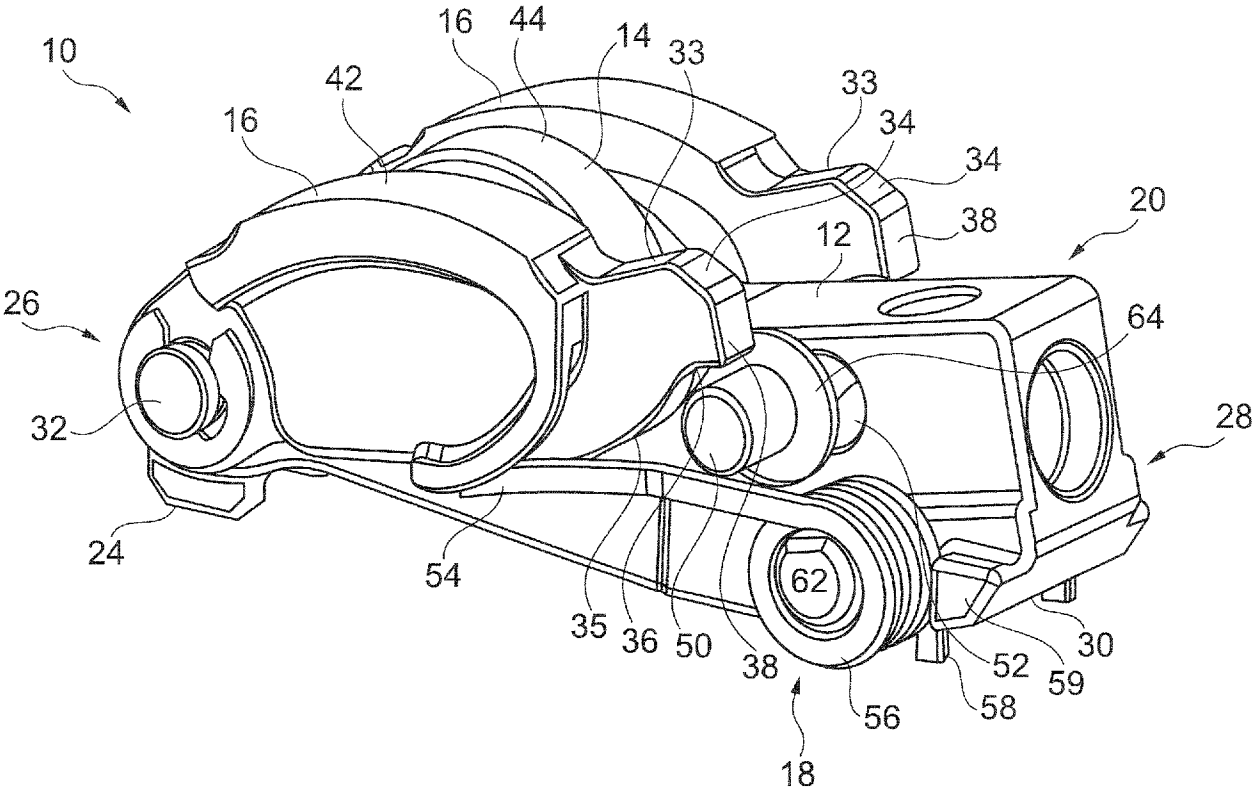
FIG. 1 is a perspective view of the finger follower of the Invention.

FIG. 1 illustrates switchable finger follower 10 having inner lever 12 in which roller 14 is mounted and outer arms 16 which are acted on by torsion spring 18. Coupler element 20 can lock arms 16 in a base position, as illustrated in FIG. 4, or can allow arms 16 to freely pivot between the base position as shown in FIG. 4 and the down position as illustrated in FIG. 5A.

Figure 3:
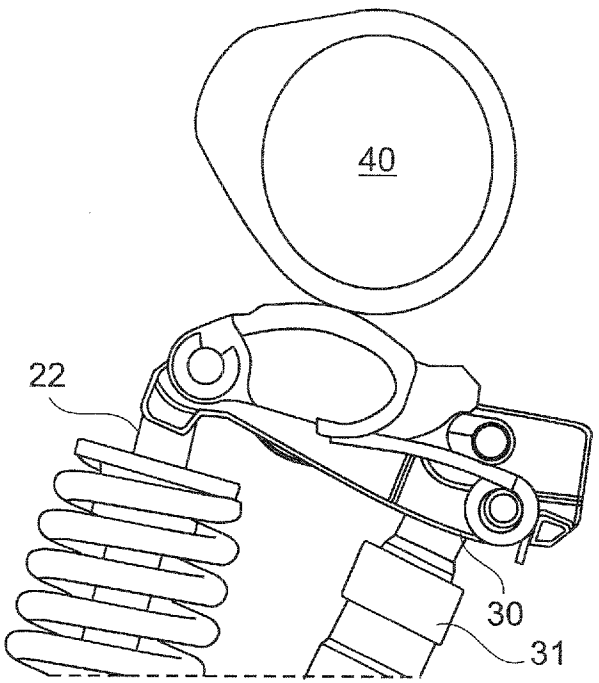
FIG. 3 is a side view of the finger follower in the unlocked mode.

Finger follower 10 operates on valve stem 22, see FIG. 3, and has valve stem support 24 located at valve stem end 26. Lash adjuster end 28 of finger follower 10, has lash adjuster contact surface 30 which is operated on by lash adjuster 31, see FIG. 3. Rod 32 allows for the pivoting action of arms 16. Arms 16 have top wall 33 with chamfered surface 34 and bottom wall 35 with locking surface 36. Between chamfered surface 34 and locking surface 36 is transverse end wall 38.

Cam 40, see FIG. 3, operates on cam contact surface 42 of arms 16 and cam contact surface 44 of roller 14.

Figure 4:
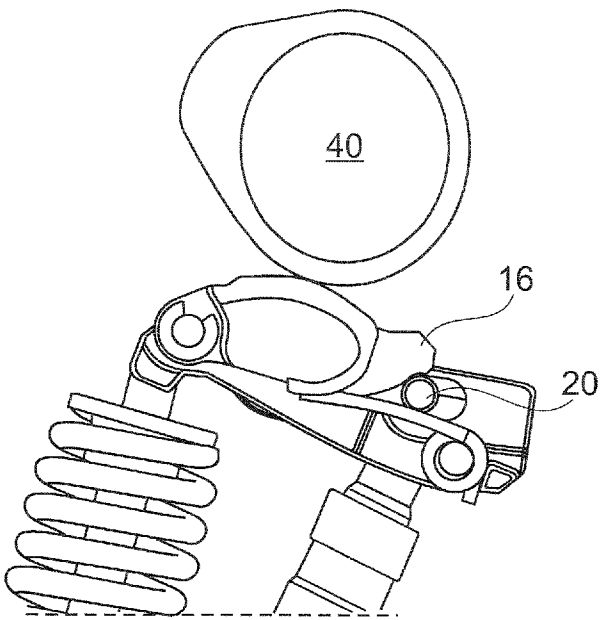
FIG. 4 is a side view of the finger follower in the locked mode.
Figure 5B:
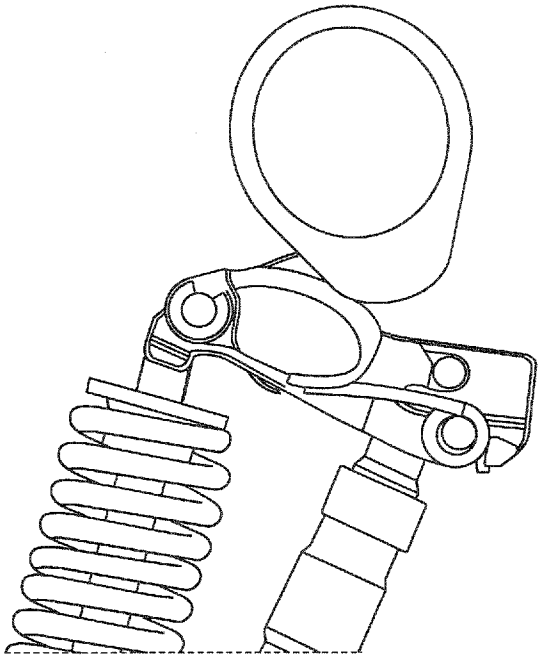
FIG. 5A-5B illustrate the arms moving the rod longitudinally rearward.
Figure 5A:
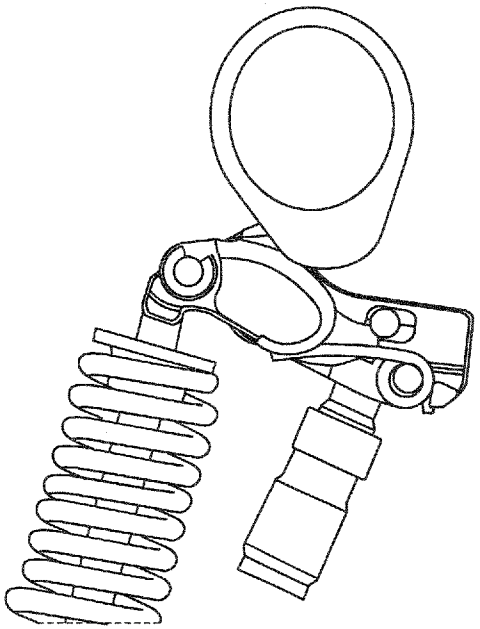

In order to lock arms 16 in the base position, as illustrated in FIG. 4, rod 50 is longitudinally movable in oblong hole 52. Oil pressure is used to move rod 50 in oblong hole 52 and the oil escapes through spray hole 53 when oil pressure is released from acting on rod 50.

Torsion spring 18 has long leg 54, coils 56 and short leg 58. Long leg 54 acts on contact surface 60 (see FIG. 10) of arm 16. Post 62 is used for mounting torsion spring 18 and stop 59 acts as a stop for short leg 58. Washer 64 maintains rod 50 centrally positioned in oblong hole 52.

Figure 2:
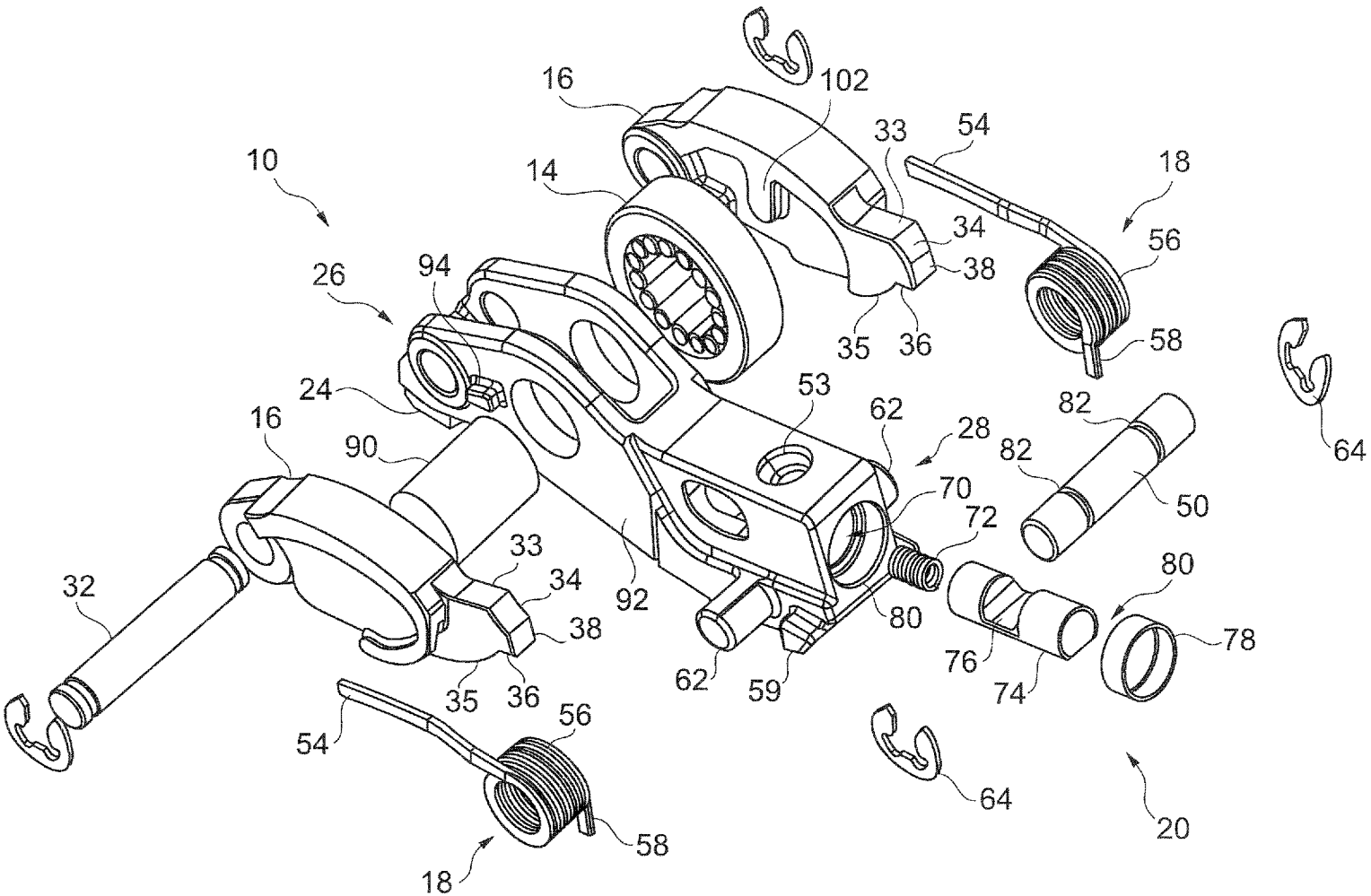
FIG. 2 is an exploded view of the finger follower of the Invention.

FIG. 2 illustrates an exploded view of finger follower 10. Coupling element 20 comprises blind bore 70 having coil spring 72, piston 74, cut out 76 in piston 74 for housing of rod 50, end cap 78 closing blind bore 70 and forming oil chamber 80 between the inside wall of end cap 78 and the end of piston 74. Oil pressure is provided to oil chamber 80 through lash adjuster 31 and an inlet in lash adjuster contact surface 30. Oil from lash adjuster 31 enters oil chamber 80 through the inlet and exits through spray hole 53. Washers 64 are press fitted onto the ends of rod 50 to hold rod 50 in a coupling element 20.

As illustrated in FIG. 3, cam 40 operates on arms 16 and roller 14 to move arms 16 and finger follower 10 up and down.

As illustrated in FIG. 4, in order to lock arms 16 in a base position, rod 50 moves longitudinally in oblong hole 52 so as to contact locking surface 36 on arm 16.

Oil pressure through a conventional oil pressure supply system is provided to oil chamber 80 through an inlet from lash adjuster 31 in order to move the piston longitudinally and thereby move rod 50 longitudinally.

When rod 50 has been moved longitudinally and arm 16 is in the down position, as illustrated in FIG. 5A, chamfered surface 34 comes into contact with rod 50 as illustrated in FIG. 5A. Because of the force of torsion spring 18 on arm 16 and the shape of surface 34, rod 50 is moved in a longitudinal manner towards the lash adjuster end 28 of finger follower 10. This allows arm 16 to move past rod 50. Once arm 16 has moved past rod 50, the oil pressure provided to oil chamber 80 allows rod 50 to move longitudinally in oblong hole 52 towards valve stem end 28 of finger follower 10, thus, allowing rod 50 to contact locking surface 36 of arm 16 as illustrated in FIG. 4.

When oil pressure is released from oil chamber 80, spring 72 moves piston 74 and rod 50 longitudinal towards lash adjuster end 28 of lever 12.

Thus, chamfered surface 34 corrects for miss-switch conditions and allows for proper locking of arm 16.

Figure 7:
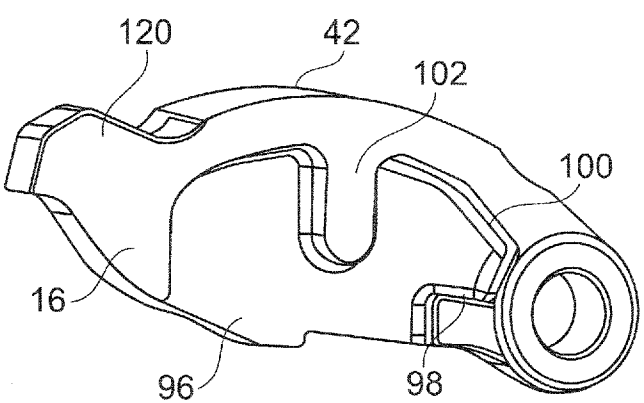
FIGS. 6 & 7 illustrate the and stops of the finger follower.
Figure 6:
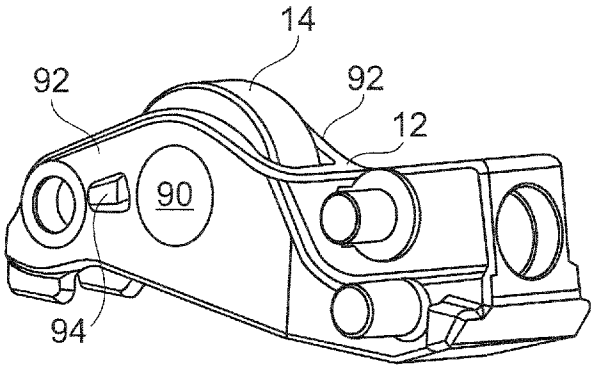

Turning to FIGS. 6 and 7, FIG. 6 illustrates a side view of inner lever 12 where roller 14 can be seen as mounted on axle 90. Mounted on longitudinal outer wall 92 of the lever 12 is inner end stop 94. As can be seen, inner end stop 94 is a finger oriented radially from the pivot axis of rod 32 and protrudes from the sidewall 92. Suitably, end stop 94 has been formed in the casting process when making lever 12. As will be appreciated, both sidewalls 92 have end stop 94 positioned thereon.

Turning to FIG. 7, FIG. 7 illustrates an inner sidewall 96 of outer arm 16. Inner sidewall 96 has two outer end stops 98 and 100. End stops 98, 100 are recessed relative to the sidewall 120 of the outer arm 16. Axle stop 102 is illustrated on inner sidewall 96.

As can be seen in FIGS. 6 and 7, end stops 94, 98 and 100 are each longitudinal fingers where inner end stop 94 is positioned between outer end stops 98 and 100. Axle stop 102 is a longitudinal finger that extends downward from top wall 33 of arm 16. As will be appreciated, when forming arm 16, axle stop 102 and end stops 98 and 100 are also formed. Thus, the formation of the axle stop 102 and end stops 94, 98 and 100 are part of the casting process when forming inner lever 12 and arm 16. Axle stop 102 has a length such that axle stop 102 opposes end surface of axle 90 throughout the stroke of arm 16. This aspect of the Invention is illustrated in FIGS. 10 and 11 which illustrate arms 16 moving through a lost motion stroke due to the action of cam 40.

Figure 8:
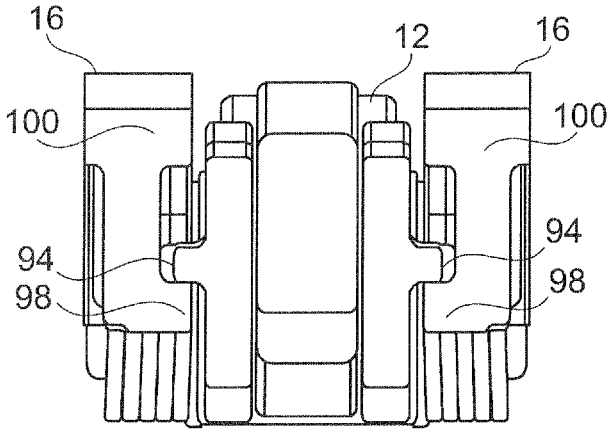
FIGS. 8 & 9 illustrate a transverse cross-section through the finger follower at the end stop.
Figure 9:
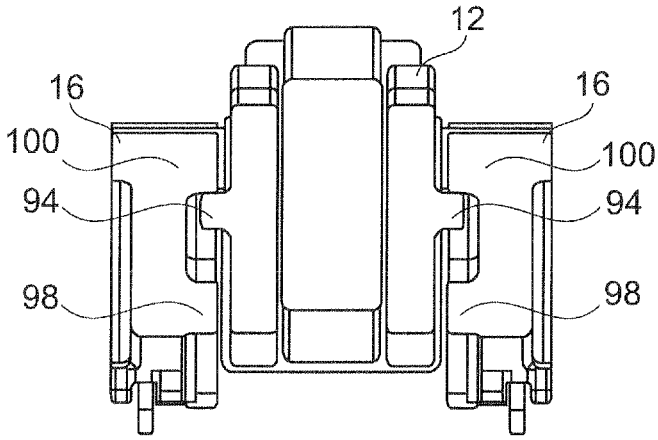

Turning to end stops 94, 98 and 100, FIGS. 8 and 9 show the interaction between the end stops during the lost motion stroke of arms 16. During normal operation of follower 10, end stops 94, 98 and 100 never meet and are only there for transporting and preventing over swing. The interaction between the end stops thereby prevents both an over swing condition and provides a hard stop for transportation of the finger follower prior to assembly and disassembly. As will be appreciated, axle stop 102 on each arm 16 maintains the axle 90 in place and allows for freedom of movement of axle 90 in finger follower 10.

Figure 10:
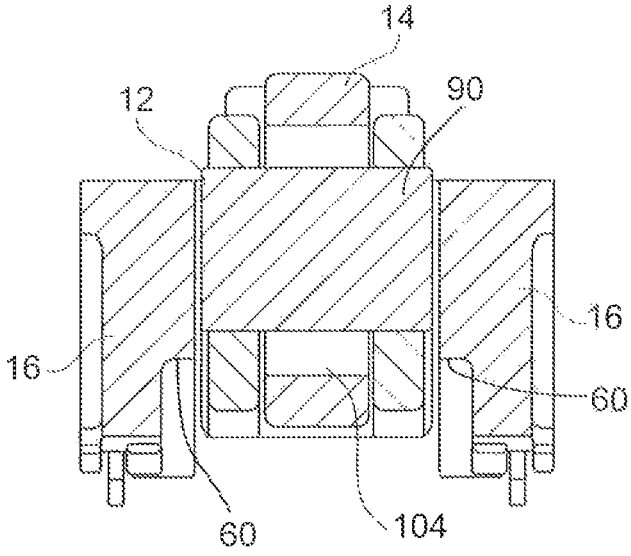
FIGS. 10 & 11 illustrate a transverse cross section through the finger follower at the axle stop.
Figure 11:
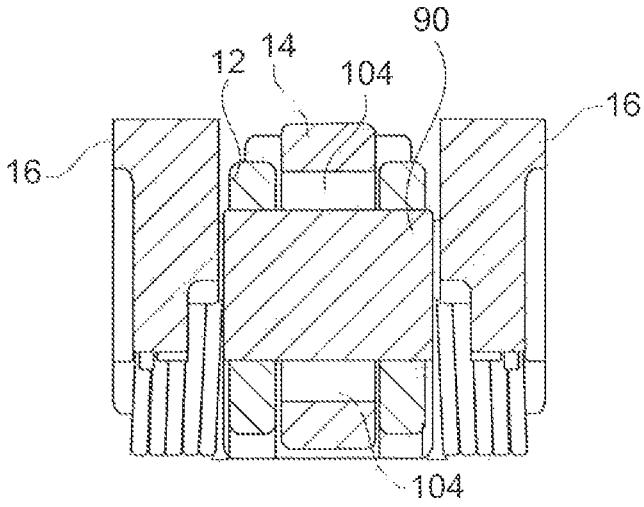
Figure 12:
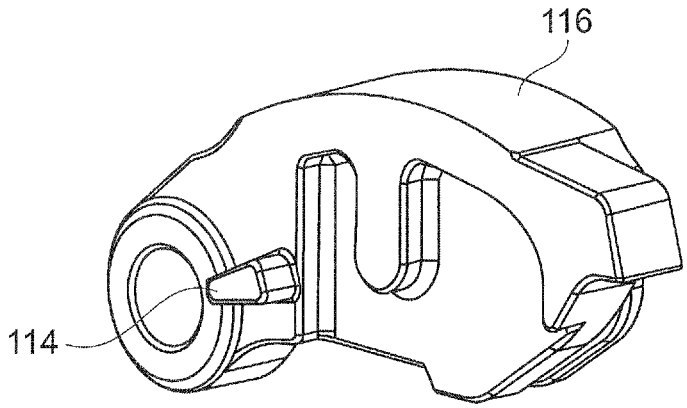
FIGS. 12 & 13 illustrate an alternative embodiment to the stops of the present Inventions.
Figure 13:
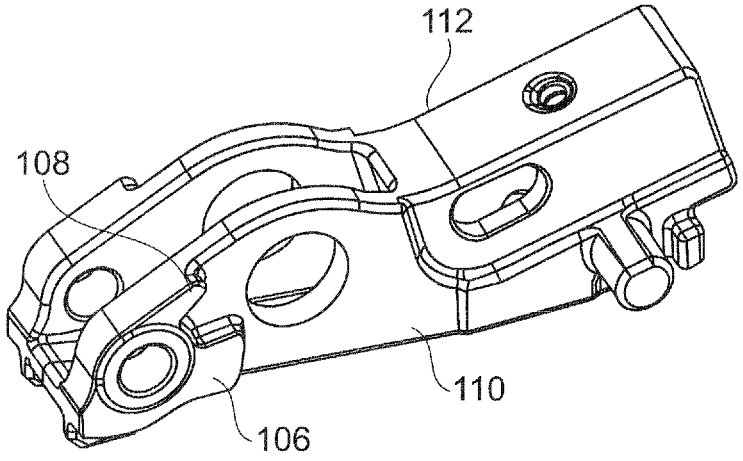

FIGS. 10 and 11 illustrate a cross section through finger follower 10 illustrating the position of axle stop 102 when arms 16 are in the down position, FIG. 10, and the base position FIG. 11. FIGS. 10 and 11 illustrate roller 14 with needle bearings 104 rotatable about axle 90.

Turning to an alternative embodiment of the stops configuration of the present Invention, FIGS. 12-15 illustrate outer end stops 106, 108 on sidewall 110 of inner lever 112 and inner end stop 114 on arm 116. The configuration and function of end stop 106, 108 and 114 mirror end stops 94, 98, 100, except for the fact that their position has been reversed.

Figure 14:
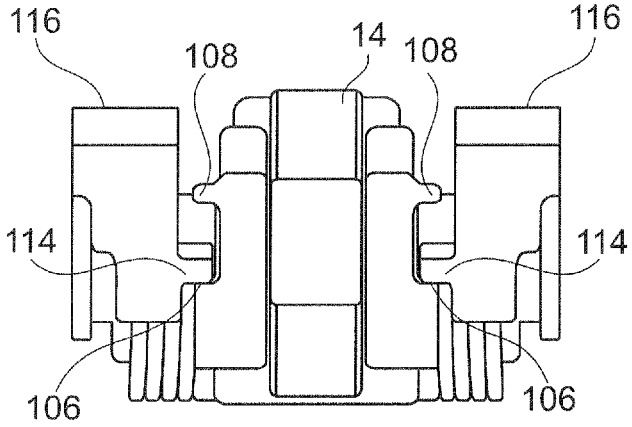
FIGS. 14 & 15 illustrate a transverse cross-section through the finger follower illustrating the stop of FIGS. 12 and 13.
Figure 15:
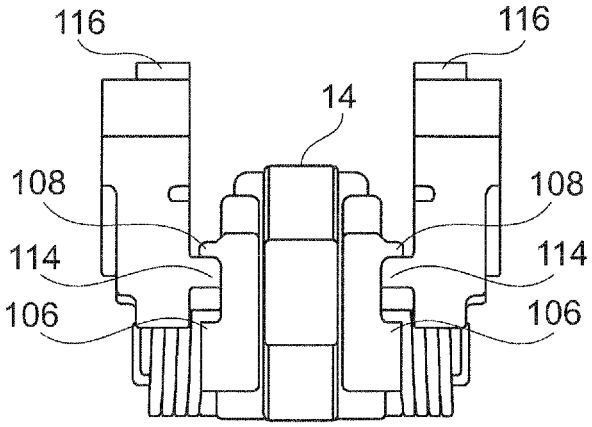

FIGS. 14 and 15 illustrate the interaction between end stops 106, 108 and 114 when arms 116 are down, FIG. 14, or in the transport position, FIG. 15.

In a dual lift application, the stops are arranged so that the inner lever with the roller provides the primary lift, and a secondary smaller lift is provided by the outer arms. In this configuration, the transport end stop is used to prevent disassembly of the entire lever assembly.

| Reference Characters | |
|---|---|
| 10 | Switchable finger follower |
| 12 | inner lever |
| 14 | roller |
| 16 | outer arms |
| 18 | torsion springs |
| 20 | coupling element |
| 22 | valve stem |
| 24 | valve stem support |
| 26 | valve stem end |
| 28 | lash adjuster end |
| 30 | lash adjuster contact surface |
| 31 | lash adjuster |
| 32 | rod |
| 33 | top wall |
| 34 | chamfered surface |
| 35 | bottom wall |
| 36 | locking surface |
| 38 | transverse end wall |
| 40 | cam |
| 42 | cam contact surface arms |
| 44 | cam contact surface roller |
| 50 | rod |
| 52 | oblong hole |
| 53 | spray hole |
| 54 | long leg |
| 56 | coil |
| 58 | short leg |
| 59 | end stop |
| 60 | contact surface |
| 62 | post |
| 64 | washer |
| 70 | blind bore |
| 72 | coil spring |
| 74 | piston |
| 76 | cut out |

-continued

| Reference Characters | |
|---|---|
| 78 | end cap |
| 80 | oil chamber |
| 90 | axle |
| 92 | sidewall |
| 94 | inner end stop |
| 96 | sidewall |
| 98 | end stop |
| 100 | end stop |
| 102 | axle stop |
| 104 | needle bearings |
| 106 | end stop |
| 108 | end stop |
| 110 | sidewall |
| 112 | inner lever |
| 114 | end stop |
| 116 | arm |
| 118 | axle stop |

I claim:

1. A switchable finger follower for a valve train of an internal combustion engine, comprising:

a longitudinally extending, inner lever having a bottom wail with a valve stem support at a first end of the lever and a lash adjuster contact surface at a second and of the lever and a slot extending through the lever from the bottom wall to a top wall of the lever;

a roller mounted on a transverse axle in the slot;

two separate, longitudinally extending outer arms, a first end of each of the arms pivotally mounted about a pivot axis at the first end of the lever, one of each of the arms mounted along one longitudinal sidewall of the lever and a second end of each of the arms extending towards the second end of the lever, each of the arms moving between a down position and a base position;

a spring means for restoring the arms to the base position;

a coupling element mounted in a transverse end wall of the second end of the lever, for engagement with a locking surface on a bottom wall, at the second end, of each of the arms to lock and unlock the arms in the base position; and one or more stops, the stops being:

(a) two outer end stops on an inner sidewall of each of the arms and an inner end stop on each outer sidewall of the inner lever, the two outer end stops extending radially from an annular ring surrounding the pivot axis of the each of the arms and respectively disposed proximate an upper surface and a lower surface of the each of the arms, the inner end stop being positioned between the outer end stops, the two outer end stops and the inner end stop interact to provide hard stops that limit two ends of a range of pivoting motion of the each of the arms relative to the lever, or (b) one inner end stop on an inner sidewall of each of the arms and two outer end stops on each outer sidewall of the inner lever, the two outer end stops extending radially from an annular ring surrounding the pivot axis of the inner lever and respectively disposed proximate an upper surface and a lower surface of the inner lever, the inner end stop positioned between the outer end stops, the two outer end stops and the inner end stop interact to provide hard stops that limit two ends of a range of pivoting motion of the each of the arms relative to the lever.

2. The follower of claim 1, wherein the stops include the two outer end stops on the inner sidewall of each of the arms and the inner end stop on each outer sidewall of the inner lever, and further include an axle stop on the inner sidewall of each of the arms that opposes an end wall of the transverse axle.

3. The follower of claim 1 wherein the stops further comprise an axle stop as an elongate finger-shaped projection formed in the inner sidewall of each arm, which opposes an end wall of the transverse axle on which the roller is mounted.

4. The follower of claim 1, wherein the stops comprise the two outer end stops on an inner sidewall of each of the arms and the inner end stop on each outer sidewall of the inner lever, and the two outer end stops and the inner end stop are fingers radially oriented about a swing axis of the arms so as to oppose one another.

5. The follower of claim 1, wherein the stops are formed as recesses and protrusions that interact with each other.

6. The follower of claim 1, wherein the stops are arranged so that the inner lever with the roller provides a primary lift and the outer arms provide a secondary, smaller lift.

7. The follower of claim 1, wherein the spring means comprises a torsion spring for each of the arms, the torsion spring having a long leg, coils, and a short leg, wherein the long leg acts on a contact surface of a respective one of the arms and the short leg acts on a stop on the follower, the lever having posts on which the coils are mounted at the second and of the lever.

* * * * *